US005206657A

United States Patent [19]

Downey

[11] Patent Number: 5,206,657

[45] Date of Patent: Apr. 27, 1993

[54] PRINTED CIRCUIT RADIO FREQUENCY ANTENNA

[75] Inventor: Walter J. Downey, San Jose, Calif.

[73] Assignee: Echelon Corporation, Palo Alto, Calif.

[21] Appl. No.: 772,239

[22] Filed: Oct. 7, 1991

[51] Int. Cl.[5] ..... H01Q 11/12

[52] U.S. Cl. ..... 343/742; 343/866

[58] Field of Search ..... 343/742, 748, 728, 732, 343/855, 866, 867

[56] References Cited

U.S. PATENT DOCUMENTS 2,650,303 8/1953 Schlesinger ..... 343/742
3,656,160 4/1972 Burton ..... 343/742

FOREIGN PATENT DOCUMENTS 1387679 3/1975 United Kingdom ..... 343/742
1537750 1/1979 United Kingdom ..... 343/742

*Primary Examiner*—Rolf Hille
*Assistant Examiner*—Hoanganh Le
*Attorney, Agent, or Firm*—Blakely, Sokoloff, Taylor & Zafman

[57] ABSTRACT

A radio frequency antenna comprises a pair of double-sided printed circuit boards that are etched on each side to form conductive loops around the periphery of each board. The circuit boards are spaced apart by standoffs and the loops are electrically coupled in series. An impedance matching network is incorporated on one of the circuit boards.

2 Claims, 1 Drawing Sheet

PRINTED CIRCUIT RADIO FREQUENCY ANTENNA

FIELD OF THE INVENTION

This invention relates to the field of radio frequency antennas, and particularly to a compact antenna for operation at approximately 50 MHz.

BACKGROUND OF THE INVENTION

Antennas for reception and transmission of electromagnetic energy in the radio frequency region of the spectrum exist in countless configurations. The design of an antenna for a particular application involves consideration of numerous constraints and criteria such as power requirements, bandwidth, radiation pattern, size and, of course, cost.

The present invention is particularly directed to an antenna for a communications transceiver in a distributed data communications network of the type described in U.S. Pat. No. 4,918,690. Such a network is well suited for use in distributed sensing and control systems for dwellings and commercial buildings. The transceiver antenna has the following performance objectives:

1. A nominal communications frequency of 49.885 MHz.
2. Small physical size so as to be conveniently installed within a typical building partition.
3. An approximately omnidirectional radiation pattern.
4. Efficient radiation of power.
5. A high Q preselector and transmit filter.
6. Ease of manufacture and low cost.

SUMMARY OF THE INVENTION

The present invention comprises a small, lightweight antenna for radiating electromagnetic energy in accordance with the foregoing objectives. The antenna comprises a pair of double-sided printed circuit boards that are etched on each side to form conductive loops around the periphery of each board. The circuit boards are held in a spaced apart relationship by means of conventional circuit board stand-offs and the loops are coupled to each other by means of a conventional two pin header-type connector. One of the circuit boards includes an impedance matching network comprising a variable capacitor and two fixed capacitors.

DETAILED DESCRIPTION OF THE INVENTION

In the following description, for purposes of explanation and not limitation, specific details are set forth, such as numbers, dimensions, circuit values, etc. in order to provide a thorough understanding of the present invention. However, it will be apparent to one skilled in the art that the present invention may be practiced in other embodiments that depart from these specific details. In other instances, detailed descriptions of well-known devices and methods are omitted so as not to obscure the description of the present invention with unnecessary detail.

Figure 1:
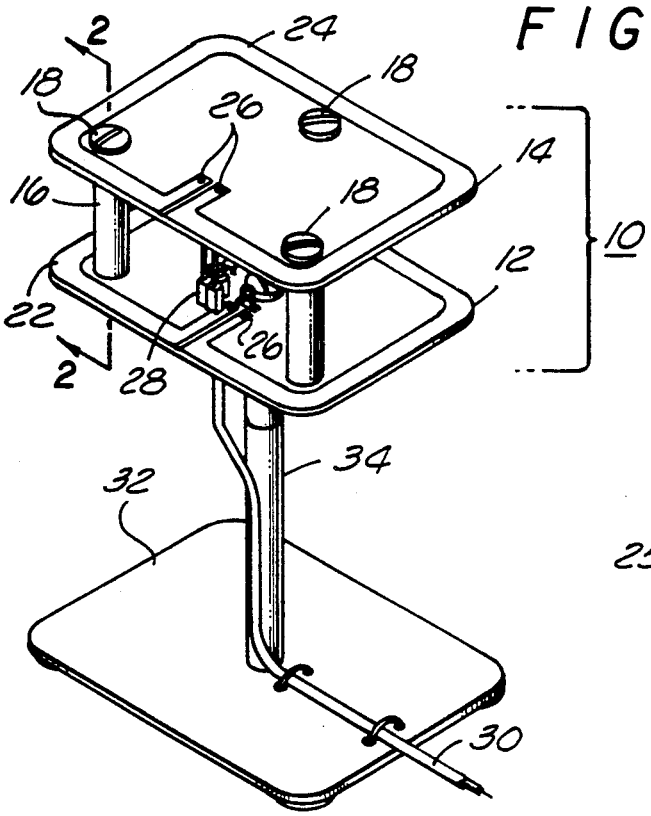
FIG. 1 is a perspective view of an antenna according to the present invention.
Figure 2:
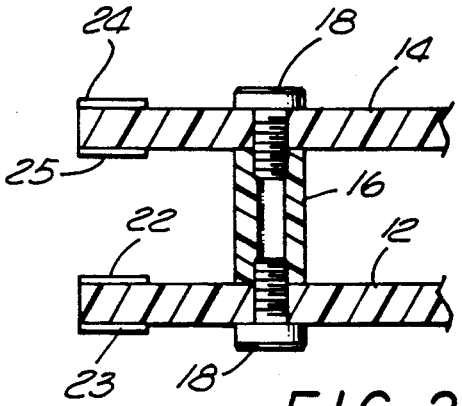
FIG. 2 is a partial cross-sectional view taken through line 2—2 of FIG. 1.

FIGS. 1 and 2 illustrate an antenna 10 according to the present invention. A lower circuit board assembly 12 is maintained in a spaced apart relationship with an upper circuit board assembly 14 by means of stand-off spacers 16. Circuit boards 12 and 14 are secured to spacers 16 by means of suitable fasteners, such as screws 18.

Circuit boards 12 and 14 are each etched to form coaxial conductive loops 22 and 24, respectively. Stacking two such loops increases the efficiency of antenna 10 by more than 5 dB in comparison to a single loop design. Preferably, circuit boards 12 and 14 have conductive cladding on each side thereof so that conductive loops may be etched on both sides of the circuit boards. Thus, conductive loop 23 (illustrated in FIG. 2) is etched on circuit board 12 opposite conductive loop 22. In like fashion, conductive loop 25 is etched on circuit board 14 opposite conductive loop 24. Each pair of conductive loops 22, 23 and 24, 25 which are disposed on opposite sides of their respective circuit boards are electrically coupled in parallel by means of plated-through holes 26; and the pairs of loops are then coupled in series as described below. Etching conductive loops on both sides of circuit board 12 and 14 reduces the skin effect and increases efficiency as compared to a single loop on each board.

The conductive loops of circuit boards 12 and 14 are electrically coupled to one another in series by means of connector 28. This connector may be a conventional two pin header-type connector, mating halves of which are soldered to appropriate circuit pads on circuit boards 12 and 14, respectively.

A source of electromagnetic energy (not shown) is coupled to conducting loops 22 and 23 of circuit board 12 by means of coaxial cable 30. The shield and center conductor of coaxial cable 30 are conveniently coupled to the conductive loops by soldering at plated-through holes 26.

A preferred embodiment of antenna 10 is designed to operate at a nominal communications frequency of 49.885 MHz. In this embodiment, circuit boards 12 and 14 have overall dimensions of approximately 2 inches by 3 inches and are separated by 0.5 inch stand-offs. Conductive loops 22–25 all have trace widths of approximately 0.2 inch.

Circuit boards 12 and 14 with their respective conductive loops are fabricated using conventional printed circuit board techniques. This not only contributes to achieving the low cost objective of this invention, but also insures consistency and reproduceability of critical antenna parameters by virtue of the accurate and repeatable characteristics of the lithographic techniques used for printing circuitry.

Circuit boards 12 and 14 are preferably of conventional copper-clad epoxy-fiberglass construction approximately 0.062 inch thick with approximately 0.0028 inch copper cladding on each side. Loops 22–25 are preferably left free of solder plating following completion of the printed circuit board fabrication process.

Antenna 10 may be mounted in a desired location by any suitable means. In the illustrated embodiment, antenna 10 is supported on stand 32 by means of support post 34. Stand 32 may also be a printed circuit board similar to boards 12 and 14, or may be made from any other suitable nonconductive material. Support post 34 may comprise one or more sections of nylon stand-off similar to spacers 16. Various other methods for mounting antenna 10 for particular applications, such as inside a building partition, will be readily apparent.

It is important to note that the design of the present invention achieves a high Q filter shape without any inductors. The antenna loops themselves form a high Q inductor necessary to build a band pass filter. Thus, the only circuit components associated with antenna 10 are three inexpensive capacitors C1–C3 for impedance matching.

Figure 3:
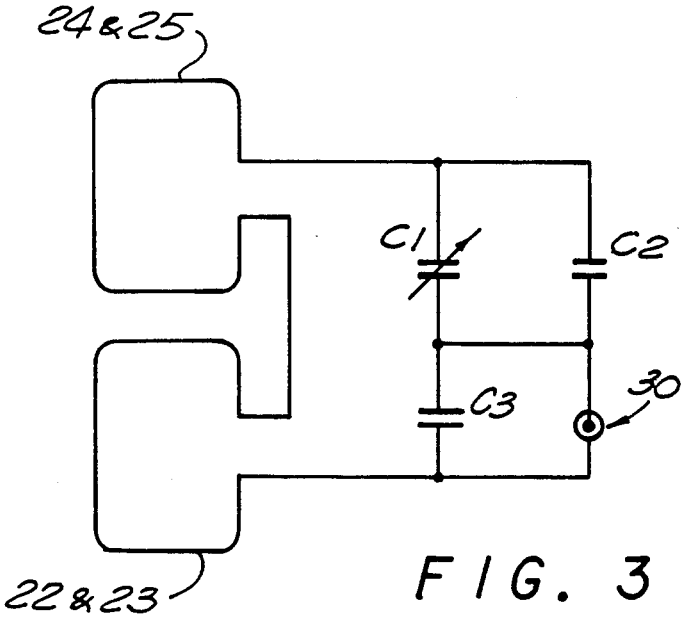
FIG. 3 is a schematic circuit diagram of the impedance matching network of the antenna in FIG. 1.

Referring now to FIG. 3, the schematic circuit layout of an impedance matching network for antenna 10 is shown. This circuit is conveniently located on circuit board 12 using conventional printed circuit techniques to form circuit traces at the same time that conductive loops 22 and 23 are etched from the cladding of board 12.

The network comprising capacitors C1–C3 is coupled in series with loops 22/23 and 24/25. Capacitor C1 is tunable to adjust the circuit for tolerances in the values of C2 and C3. In the preferred embodiment, the impedance of antenna 10 is matched to 50 ohms and capacitors C1–C3 have the following values:

C1—2–21 pf
C2—27 pf
C3—470 pf

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

I claim:

1. A radio frequency antenna for operation at a nominal frequency comprising:

a first circuit board etched on each side thereof to form a first pair of coaxial congruent conductive loops, each loop having a perimeter much smaller than a wavelength corresponding to the nominal frequency;

a second circuit board etched on each side thereof to form a second pair of coaxial congruent conductive loops congruent with the first pair of conductive loops;

spacer means for maintaining the first and second circuit boards in a fixed spaced apart relationship with the first and second pairs of conductive loops in a coaxial relationship;

circuit connection means for electrically coupling the first and second pairs of conductive loops in a series relationship.

2. The antenna of claim 1 wherein the nominal frequency is 49.885 MHz and the perimeter of the conductive loops is approximately 10 inches.

* * * * *